US010602811B2

(12) United States Patent
Adachi

(10) Patent No.: US 10,602,811 B2
(45) Date of Patent: Mar. 31, 2020

(54) FASTENER STRINGER, SLIDE FASTENER, AND FASTENER STRINGER ATTACHMENT STRUCTURE

(71) Applicant: YKK Corporation, Tokyo (JP)

(72) Inventor: Takefumi Adachi, Tokyo (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 16/278,140

(22) Filed: Feb. 17, 2019

(65) Prior Publication Data

US 2019/0254388 A1 Aug. 22, 2019

(30) Foreign Application Priority Data

Feb. 19, 2018 (JP) ..... 2018-026803

(51) Int. Cl.

| | |
|---|---|
| ***A44B 19/24*** | (2006.01) |
| ***A44B 19/34*** | (2006.01) |
| ***A44B 19/40*** | (2006.01) |
| *A44B 19/32* | (2006.01) |

(52) U.S. Cl.

CPC ..... *A44B 19/34* (2013.01); *A44B 19/40* (2013.01); *A44B 19/32* (2013.01)

(58) Field of Classification Search

CPC ..... A44B 19/34; A44B 19/40

See application file for complete search history.

(56) References Cited

U.S. PATENT DOCUMENTS 3,430,304 A * 3/1969 Swainson ..... A44B 19/00 24/394
3,789,465 A * 2/1974 Moertel ..... A44B 19/12 24/395
3,855,672 A * 12/1974 Takamatsu ..... A44B 19/12 24/394
3,885,273 A * 5/1975 Heimberger ..... A44B 19/14 24/401
3,922,760 A * 12/1975 Matsuda ..... A44B 19/343 24/393
3,952,380 A * 4/1976 Takamatsu ..... A44B 19/343 24/393
3,974,550 A * 8/1976 Fujisaki ..... A44B 19/343 24/393
4,125,911 A * 11/1978 Moertel ..... A44B 19/34 24/398
4,143,680 A * 3/1979 Murai ..... A44B 19/346 139/384 B
4,291,440 A * 9/1981 Yoshida ..... A44B 19/14 24/408

(Continued)

FOREIGN PATENT DOCUMENTS

JP 5269103 B 8/2013

*Primary Examiner* — Jason W San

(74) *Attorney, Agent, or Firm* — Kilpatrick Townsend & Stockton LLP

(57) ABSTRACT

A slide fastener includes a right and left pair of first fastener stringers and second fastener stringer, and a slider. The first fastener stringer and the second fastener stringer each include a fastener tape, a fastener element array, and a restricting unit restricting displacement of right and left cover materials away from each other. The restricting unit is configured to form a space that receives a side periphery of each of the cover materials between the restricting unit and the fastener tape.

9 Claims, 17 Drawing Sheets

(56) References Cited

U.S. PATENT DOCUMENTS 4,331,493 A * 5/1982 Lawrence ..... A44B 19/04 156/216
4,566,156 A * 1/1986 Sarasue ..... A44B 19/34 24/397
4,580,321 A * 4/1986 Tanikawa ..... A44B 19/32 24/389
4,601,085 A * 7/1986 Yoshida ..... A44B 19/32 24/384
4,724,586 A * 2/1988 Tsubokawa ..... A44B 19/32 24/384
5,111,919 A * 5/1992 Hamatani ..... A45C 5/03 190/109
5,129,127 A * 7/1992 Hamatani ..... A44B 19/34 24/393
5,386,616 A * 2/1995 Norvell ..... A44B 19/32 24/384
6,345,709 B1 * 2/2002 Cheng ..... A45C 13/103 190/119
6,427,294 B1 * 8/2002 Shibaike ..... A44B 19/32 24/381
6,668,384 B1 * 12/2003 Chang ..... A41D 3/00 2/96
6,877,192 B2 * 4/2005 Tominaga ..... A44B 19/12 24/381
7,143,878 B2 * 12/2006 Selvi ..... A45C 5/03 190/103
7,293,434 B2 * 11/2007 Ikeguchi ..... A44B 19/40 66/193
8,083,040 B2 * 12/2011 Chiang ..... A44B 19/34 190/119
8,397,353 B2 * 3/2013 Chou ..... A44B 19/32 24/391
8,739,372 B2 * 6/2014 Hasegawa ..... A44B 19/08 24/392
9,015,909 B2 * 4/2015 Daijogo ..... A44B 19/08 24/392
9,089,187 B2 * 7/2015 Takano ..... A44B 19/08
9,173,458 B2 * 11/2015 Wang ..... A44B 19/42
10,080,405 B2 * 9/2018 Cheng ..... A44B 19/08
2001/0013158 A1 * 8/2001 Yamaguchi ..... A44B 19/40 24/391
2005/0235466 A1 * 10/2005 Segawa ..... A44B 19/34 24/396
2006/0010660 A1 * 1/2006 Stenhall ..... A44B 19/32 24/389
2010/0125982 A1 * 5/2010 Chou ..... A44B 19/32 24/397

* cited by examiner

FASTENER STRINGER, SLIDE FASTENER, AND FASTENER STRINGER ATTACHMENT STRUCTURE

The entire disclosure of Japanese Patent Application No. 2018-026803 filed Feb. 19, 2018 is expressly incorporated by reference herein.

TECHNICAL FIELD

The present invention relates to a fastener stringer configured to connect cover materials such as a sheet cover of an automobile, a slide fastener, and a fastener stringer attachment structure.

BACKGROUND ART

A known typical slide fastener intended to be attached to a sheet cover (cover materials) of an automobile includes: a pair of right and left fastener stringers including respective fastener tapes and respective sequential element arrays; and a slider configured to engage and disengage the right and left sequential element arrays (see Patent Literature 1: Japanese Patent No. 5269103).

Each fastener tape is bent in a U-shape to form a groove and a belt-shaped restricting member is received in the groove of the fastener tape. The belt-shaped restricting member is sewed to the corresponding fastener tape so that the right and left fastener tapes are restricted from being displaced in a right-left direction to be separated from each other when a force is applied to separate the fastener tapes from each other in the right-left direction.

In the slide fastener of Patent Literature 1, the restricting member restricts separation of the fastener tapes from each other, preventing formation of a gap between the right and left fastener tapes.

However, the restricting member of the slide fastener of Patent Literature 1 cannot restrict the cover materials, to which the right and left fastener tapes are attached, from being separated from each other in the right-left direction, although the restricting member can prevent separation of the right and left fastener tapes.

Thus, when a force is applied to the right and left cover materials to separate them in the right-left direction, a gap is likely to be formed between the right and left cover materials, making the fastener tape(s) exposed.

SUMMARY OF THE INVENTION

An object of the invention is to provide a fastener stringer, a slide fastener, and a fastener stringer attachment structure that are capable of preventing separation of cover materials.

According to an aspect of the invention, a fastener stringer configured to be attached to a cover material, the fastener stringer includes: a fastener tape; a fastener element array fixed to the fastener tape; and a restricting unit provided along a longitudinal direction of the fastener tape, the restricting unit being configured to form a space receiving a side periphery of the cover material between the restricting unit and the fastener tape.

According to the invention, the side periphery of the cover material is received between the fastener tape and the restricting unit, holding the side periphery of the cover material. In addition, by folding the side periphery of the cover material to cover a front side of the restricting unit, the fastener stringer is kept from being exposed at a front side of the cover material.

Further, when the respective fastener element arrays of the pair of right and left fastener stringers are engaged with each other, the right and left cover materials are bordered on each other to cover the respective fastener tapes. If a force is applied to the right and left cover materials to separate them in a right-left direction, the respective restricting units would restrict the displacement of the cover materials away from each other. The right and left cover material can thus be prevented from separating from each other, so that the fastener tapes are less likely to be exposed outside.

It should be noted that a holding strength for each cover material can be increased when the side periphery of the cover material is connected to the fastener tape and the restricting unit by, for instance, sewing.

In the above aspect, the restricting unit may be attached to the fastener tape at a position spaced from the fastener element array in a width direction of the fastener tape.

With the above arrangement, the fastener element array, the fastener tape, and the restricting unit define a continuous fastener stringer. For instance, such a fastener stringer is easy to handle before being attached to the corresponding cover material as compared with a fastener stringer including a fastener tape and a restricting unit formed as separate components.

Further, the space receiving the side periphery of the corresponding cover material can be easily formed between the fastener tape and the restricting unit merely by folding the fastener tape.

In the above aspect, the restricting unit may include: an attachment piece attached to the fastener tape; a main piece configured to form the space receiving the side periphery of the cover material between the main piece and the fastener tape; and a bendable piece continuous with the attachment piece and the main piece.

The above arrangement allows the main piece to be folded with respect to the attachment piece by bending the bendable piece of the restricting unit without the necessity of folding the fastener tape, easily forming the space receiving the side periphery of the corresponding cover material between the main piece and the fastener tape.

Further, the bendable piece of the restricting unit is clearly defined as a bending position, thus eliminating variation in bending position between the pair of fastener stringers as compared with an instance where the fastener tape would be bent.

In the above aspect, the restricting unit may be a member separate from the fastener tape and connectable to the fastener tape at a position for the restricting unit to form the space receiving the side periphery of the cover material between the restricting unit and the fastener tape.

The above arrangement allows for forming the space receiving the side periphery of the corresponding cover material without the necessity of folding the fastener tape and/or the restricting unit as compared with an instance where, for instance, the restricting unit would be attached to the fastener tape. A position of the restricting unit can thus be determined as desired irrespective of the width of the fastener tape. Further, the restricting unit is connected to the fastener tape by, for instance, sewing at a position for the restricting unit to form the space receiving the side periphery of the cover material between the restricting unit and the fastener tape, so that the displacement of the restricting unit can be restricted. The restricting unit thus allows for restricting the displacement of the cover materials right and left away from each other.

In the above aspect, the restricting unit may be in a belt shape along the longitudinal direction of the fastener tape, and at least a first side periphery of the restricting unit may be provided with at least one restricting groove juxtaposed along a longitudinal direction of the restricting unit.

With the above arrangement, the juxtaposed restricting groove(s) provided to the restricting unit allows for forming a narrow portion in the restricting unit, so that the belt-shaped restricting unit can be easily bent right and left. The restricting unit can thus be easily curved in conformity with the curve of the side periphery of the corresponding cover material so that, for instance, the right and left cover materials are curved to be connected.

It should be noted that the restricting groove(s) may be provided to either one of the inner or outer side peripheries of the restricting unit in the right-left direction (i.e., the width direction of the restricting unit) or may be provided to each side periphery of the restricting unit in the right-left direction (i.e., the width direction of the restricting unit).

In the above aspect, the first side periphery of the restricting unit may be provided with the at least one restricting groove, a second side periphery of the restricting unit may be continuous along the longitudinal direction of the restricting unit, and the first side periphery of the restricting unit may be located outside in a right-left direction when the space receiving the cover material is formed between the fastener tape and the restricting unit.

For instance, in connecting the right and left cover materials to each other in a curve, the above arrangement, in which the first side periphery of the restricting unit is provided with the restricting groove(s), allows the restricting unit to be easily curved in conformity with the curve of the side periphery of the corresponding cover material.

Further, the restricting groove(s) is located outside in the right-left direction with the space for receiving the cover material being formed between the fastener tape and the restricting unit, while the continuous second side periphery of the restricting unit is located inside in the right-left direction. Thus, if a force is applied to the right and left cover materials to separate them in the right-left direction, the continuous second side periphery of the restricting unit can receive the corresponding cover material, preventing the cover material from being stuck in the restricting groove(s) to unintentionally cause wrinkles or the like on the corresponding cover material. Thus, the right and left cover materials can be smoothened in appearance without such wrinkles or the like at a curved connection portion.

In the above aspect, the restricting unit may include a plurality of restricting members juxtaposed at a distance along the longitudinal direction of the fastener tape, and the plurality of restricting members may have respective side peripheries that are located inside in a right-left direction when the space receiving the side periphery of the cover material is formed between the fastener tape and the restricting unit, a distance between the respective side peripheries being smaller than a distance between the other portions of the plurality of restricting members that are located outside in the right-left direction with respect to the respective side peripheries.

The above arrangement, in which the plurality of restricting members are juxtaposed at the distance, allows the first fastener stringer to be easily bendable right and left as compared with, for instance, a belt-shaped restricting unit. Thus, for instance, in connecting the right and left cover materials to each other in a curve, the fastener stringer can be easily bent in conformity with the curve of the side periphery of the corresponding cover material.

Further, the distance between the respective side peripheries of the plurality of restricting members located inside in the right-left direction is smaller than the distance between the other portions thereof located outside in the right-left direction with respect to the respective side peripheries. Thus, if a force is applied to the right and left cover materials to separate them in the right-left direction, the cover materials are less likely to be stuck between the side peripheries of the plurality of restricting members located inside in the right-left direction, reducing unintentional wrinkles or the like of the cover materials. This results in a smooth appearance of the right and left cover materials with wrinkles or the like being reduced at a curved connection portion as described above.

Further, as compared with, for instance, a belt-shaped continuous restricting unit, the restricting unit including the plurality of restricting members can eliminate the necessity of forming a continuous portion, thus reducing material costs.

In the above aspect, the fastener stringer may further include a support at a position for the support to receive the side periphery of the cover material and the fastener tape between the support and the restricting unit when the restricting unit is at a position for the restricting unit to form the space receiving the cover material between the restricting unit and the fastener tape.

If a force is applied to the right and left cover materials to separate them in the right-left direction, the restricting unit(s) would tend to incline such that the side periphery thereof inside in the right-left direction rises and the side periphery outside in the right-left direction recedes. However, the above arrangement, in which the support supports the restricting unit, restricts such inclination, thus keeping the right and left cover materials in contact with each other.

According to another aspect of the invention, a slide fastener includes: a pair of right and left fastener stringers: and a slider configured to engage the pair of right and left fastener stringers, the pair of right and left fastener stringers being each the fastener stringer of the above aspect.

The slide fastener of this aspect can achieve the same effects as those of the above-described fastener stringers.

According to still another aspect of the invention, a fastener stringer attachment structure includes: a pair of right and left fastener stringers; and right and left cover materials configured to be attached with the pair of right and left fastener stringers, respectively, in which the pair of right and left fastener stringers are each the fastener stringer of the above aspect, and the right and left cover materials are each received at a side periphery thereof between the fastener tape and the restricting unit of corresponding one of the pair of right and left fastener stringers, while being folded with respect to the side periphery to cover the restricting unit.

The fastener stringer attachment structure of this aspect can achieve the same effects as those of the above-described fastener stringers. It should be noted that the pair of right and left fastener stringers are engaged with each other by moving the slider through between the respective fastener element arrays.

According to the above aspects of the invention, a fastener stringer, a slide fastener, and a fastener stringer attachment structure that are capable of preventing separation of cover materials can be provided.

BRIEF DESCRIPTION OF DRAWING(S)

DESCRIPTION OF EMBODIMENT(S)

First Exemplary Embodiment

A first exemplary embodiment of the invention will be described below with reference to the attached drawings.

Figure 1:
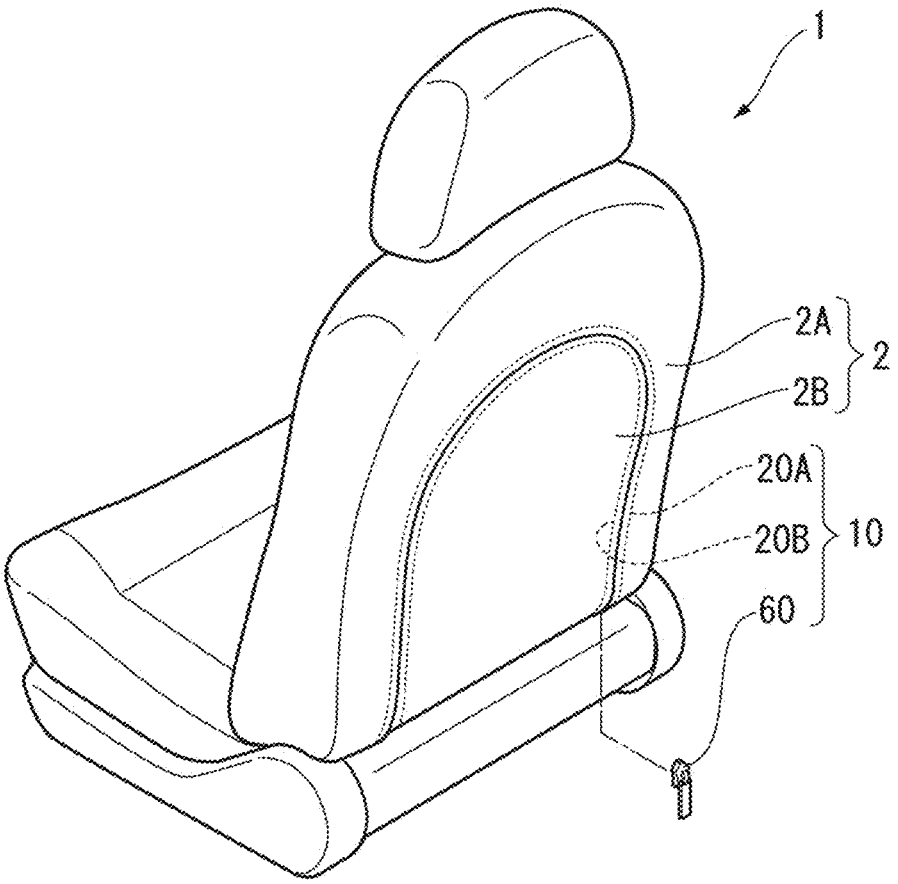
FIG. 1 is a perspective view showing a car seat attached with a slide fastener according to the invention.
Figure 2:
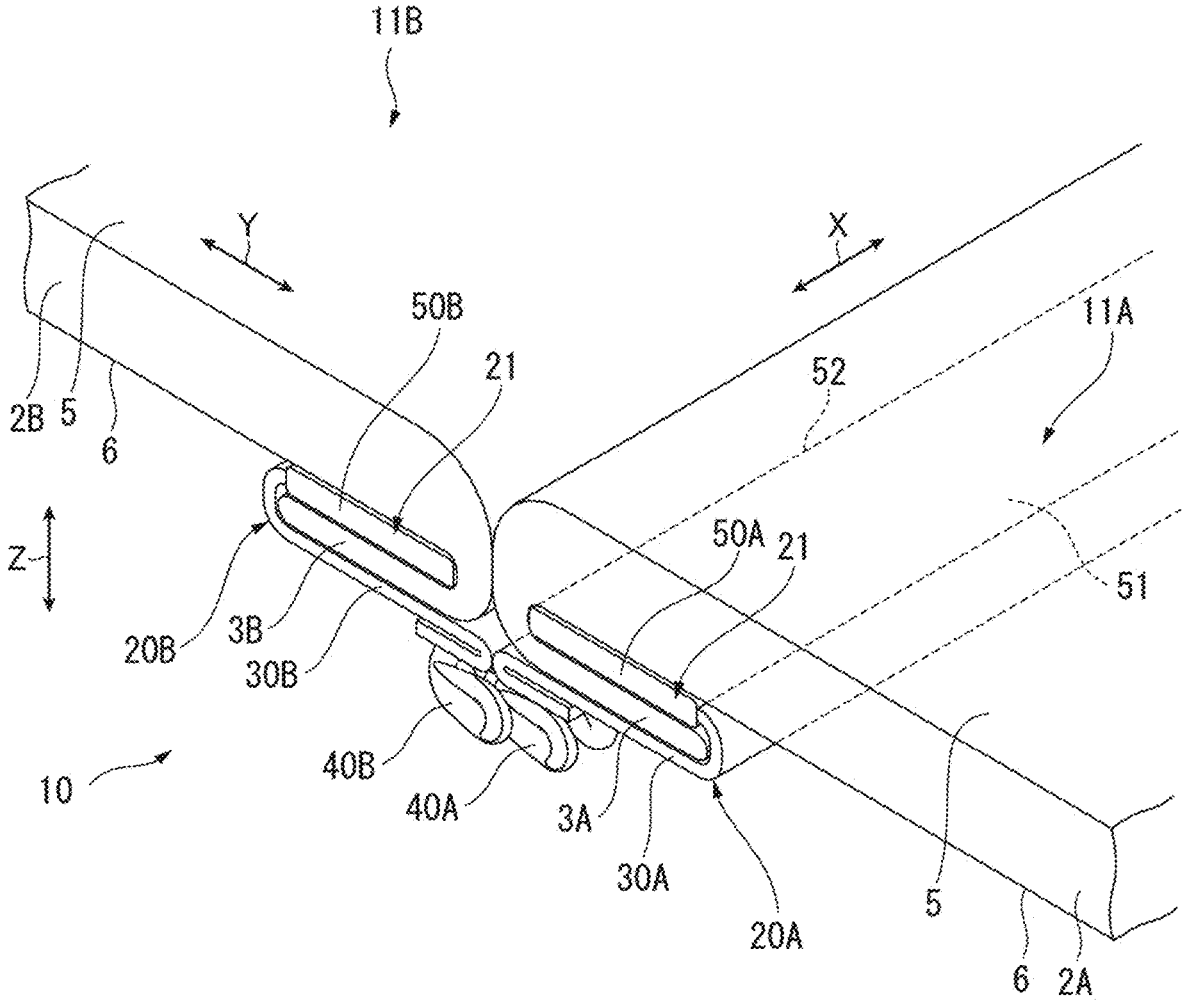
FIG. 2 is a perspective view showing a slide fastener according to a first exemplary embodiment of the invention.
Figure 3:
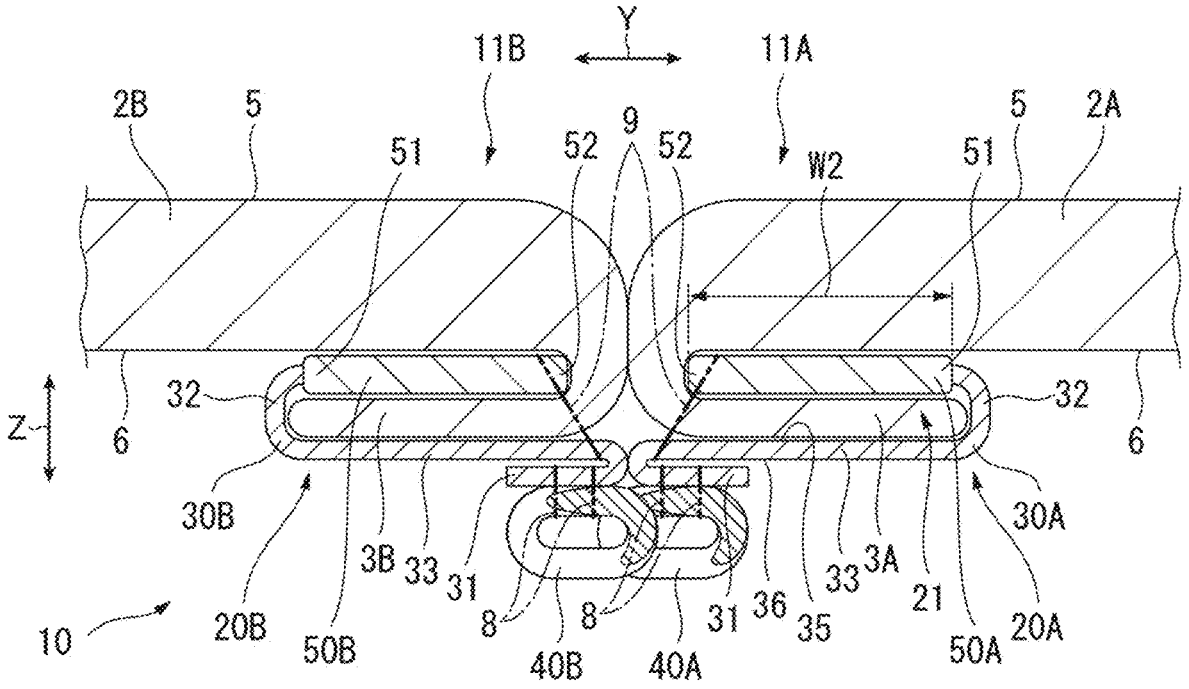
FIG. 3 is a cross sectional view showing the slide fastener according to the first exemplary embodiment.
Figure 4:
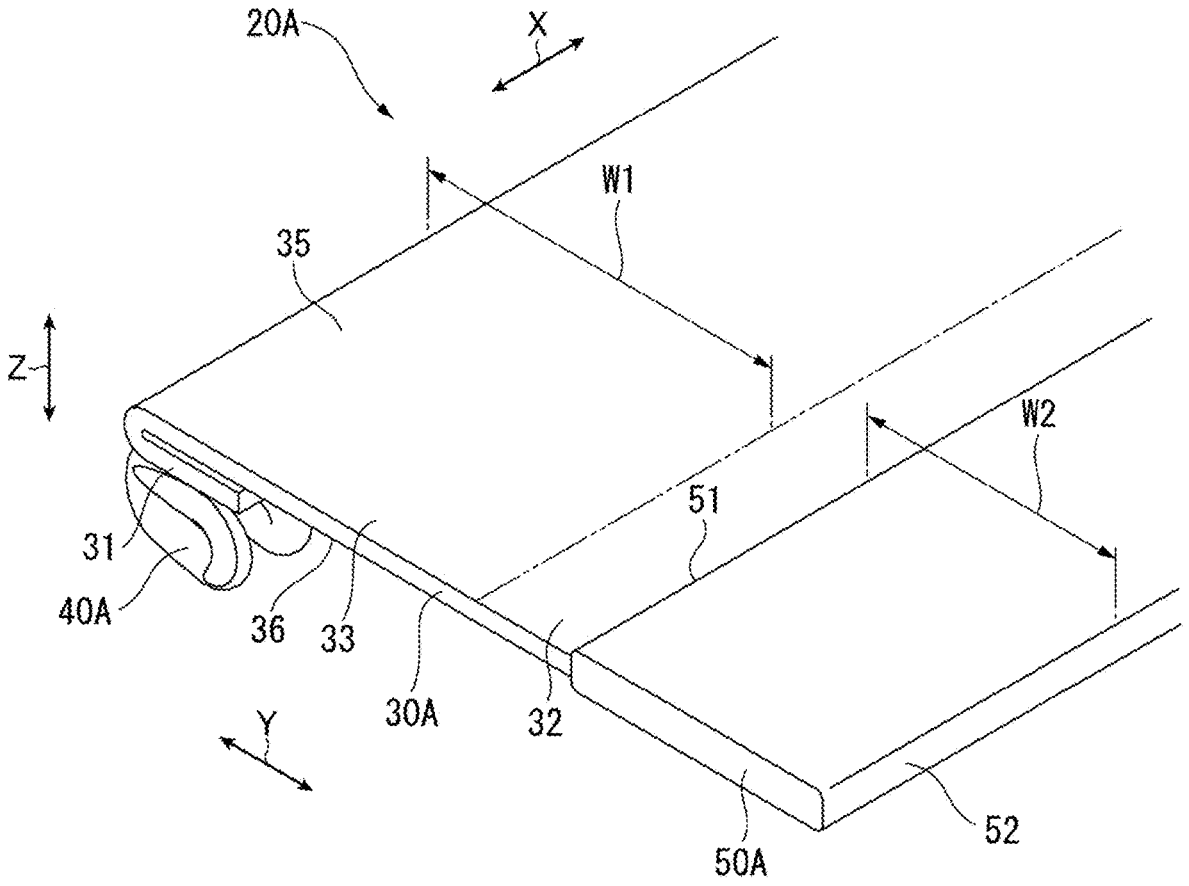
FIG. 4 is a perspective view showing a fastener stringer according to the first exemplary embodiment.

Referring to FIGS. 2 to 4, a slide fastener 10 according to the first exemplary embodiment is configured to connect cover materials 2 (2A, 2B) of a seat cover for a car seat 1 shown in FIG. 1.

In the following description, a length direction of the slide fastener 10 is referred to as an X-axis direction, a right-left direction of the slide fastener 10 as a Y-axis direction, and a thickness direction of the slide fastener 10 as a Z-axis direction. The X-, Y-, and Z-axis directions are perpendicular to each other.

As shown in FIGS. 1 to 3, the slide fastener 10 includes a pair of first fastener stringer 20A and second fastener stringer 20B opposing each other in the Y-axis direction and a slider 60 (see FIG. 1) configured to engage the first fastener stringer 20A and the second fastener stringer 20B.

The slider 60, which is configured to slide to engage later-described fastener element arrays 40A, 40B to each other, is removable from respective ends of the fastener element arrays 40A, 40B in this exemplary embodiment.

As shown in FIGS. 2 and 3, when the first fastener stringer 20A and the second fastener stringer 20B are engaged with each other, the right and left cover materials 2A, 2B are in contact with each other.

As shown in FIG. 4, the first fastener stringer 20A includes a fastener tape 30A extending in the X-axis direction, the fastener element array 40A fixed to the fastener tape 30A, and a restricting unit 50A provided along a longitudinal direction (X-axis direction) of the fastener tape 30A.

The fastener tape 30A is flexible and thus bendable (e.g., foldable). A side periphery 31 of the fastener tape 30A in a width direction (Y-axis direction) is sewed to the fastener element array 40A with a sewing thread 8. An opposite side periphery 32 of the fastener tape 30A in the width direction is attached with the restricting unit 50A. A tape body 33 of the fastener tape 30A defined between the side peripheries 31, 32 has a width W1 as shown in FIG. 4.

The fastener element array 40A, which is provided by a linear element of a synthetic resin monofilament formed into a coil shape, is engageable with the fastener element array 40B provided to the second fastener stringer 20B.

The restricting unit 50A, which is formed into a belt shape from a hard synthetic resin such as polyamide, polyacetal, polypropylene, and polybutylene terephthalate, exhibits flexibility such that the restricting unit 50A is bendable in conformity with the bend of the cover material 2A.

A side periphery 51 of the restricting unit 50A in the width direction is attached with the side periphery 32 of the fastener tape 30A. An opposite side periphery 52 of the restricting unit 50A in the width direction is free. The restricting unit 50A is spaced from the fastener element array 40A at a distance in the Y-axis direction.

The restricting unit 50A has a width W2 equal to or less than the width W1 of the tape body 33. Thus, when the side periphery 32 of the fastener tape 30A is folded as shown in FIG. 3, the restricting unit 50A is located within the width W1 of the tape body 33.

The first fastener stringer 20A is attached to the cover material 2A as follows.

First, the first fastener stringer 20A in the state shown in FIG. 4 is prepared. The side periphery 31 of the fastener tape 30A is folded to face a rear surface 36 of the tape body 33, while the restricting unit 50A extends along the tape body 33 in the Y-axis direction. A front surface 35 of the fastener tape 30A at the tape body 33 is then placed facing a front surface 5 of the cover material 2A at a side periphery 3A of the cover material 2A.

Figure 5:
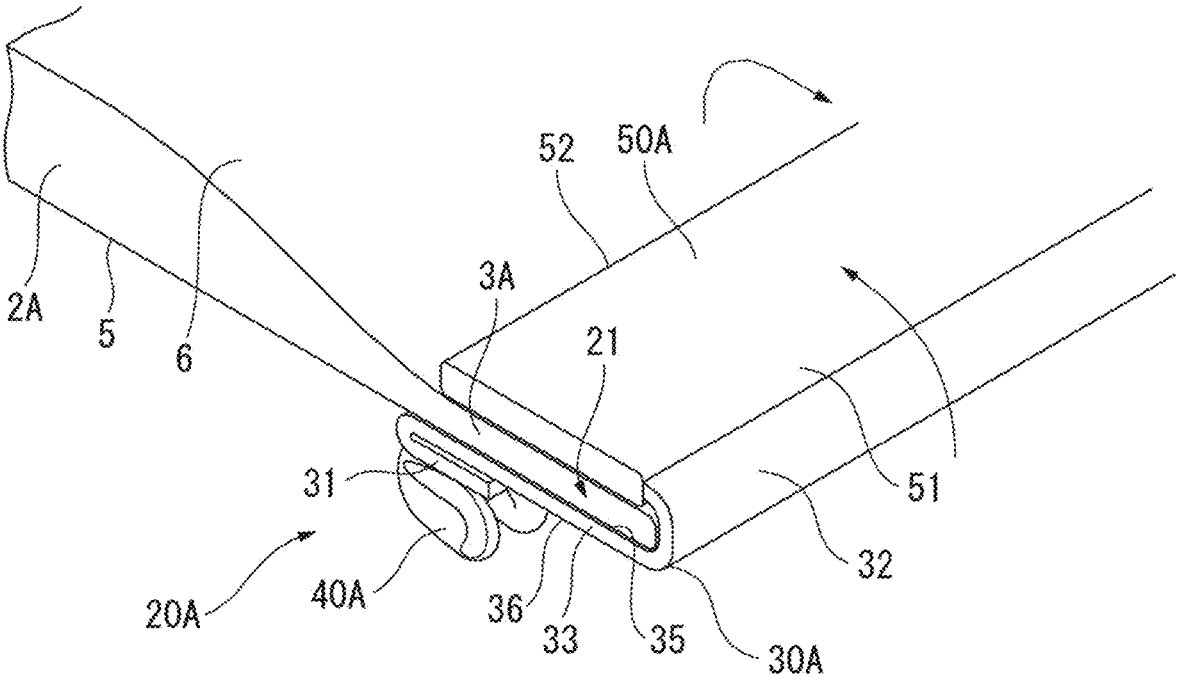
FIG. 5 is a perspective view showing a process of attaching the fastener stringer according to the first exemplary embodiment.

Subsequently, as shown in FIG. 5, the side periphery 32 of the fastener tape 30A is folded to face the front surface 35 of the tape body 33, forming a space 21 between the restricting unit 50A and the tape body 33. At this time, the side periphery 51 of the restricting unit 50A is located outside in the right-left direction and the side periphery 52 is located inside in the right-left direction. The side periphery 3A of the cover material 2A is received in the space 21. The side periphery 3A of the cover material 2A is received between the tape body 33 and the restricting unit 50A to be compressively deformed and sewed, as it is deformed, to the restricting unit 50A and the fastener tape 30A with a sewing thread 9 (see FIG. 3).

Specifically, the restricting unit 50A and the fastener tape 30A are connected to each other by sewing, with the sewing thread 9, the side periphery 52 of the restricting unit 50A and a portion of the tape body 33 bordering on the side periphery 31 to receive the side periphery 3A of the cover material 2A therebetween so that the restricting unit 50A is unlikely to be displaced outward in the right-left direction with respect to the tape body 33. However, the restricting unit 50A and the fastener tape 30A may be sewed together in any different manner as long as they are sewed with the side periphery 3A of the cover material 2A being received therebetween. This applies to later-described second and third exemplary embodiments.

At the end, the cover material 2A is folded with respect to the side periphery 3A to cover the restricting unit 50A at a front side thereof (an upper side in the Z-axis direction in FIG. 3). When the first fastener stringer 20A is attached to the cover material 2A as described above, a fastener stringer attachment structure 11A is defined by the first fastener stringer 20A and the cover material 2A (see FIGS. 2 and 3).

As shown in FIGS. 2 and 3, the second fastener stringer 20B, which is symmetric to the first fastener stringer 20A right and left, includes a fastener tape 30B, the fastener element array 40B, and a restricting unit 50B, which are structurally the same as the fastener tape 30A, the fastener element array 40A, and the restricting unit 50A of the first fastener stringer 20A, respectively.

The second fastener stringer 20B is attached to the cover material 2B in the same manner as the above-described first fastener stringer 20A being attached to the cover material 2A. A fastener stringer attachment structure 11B is thus defined by the second fastener stringer 20B and the cover material 2B.

Effects of First Exemplary Embodiment (1) In the first exemplary embodiment, the first fastener stringer 20A includes the fastener tape 30A, the fastener element array 40A fixed to the fastener tape 30A, and the restricting unit 50A provided along the longitudinal direction of the fastener tape 30A, the restricting unit 50A being configured to form the space 21 receiving the side periphery 3A of the cover material 2A between the restricting unit 50A and the fastener tape 30A.

The above configuration allows the side periphery 3A of the cover material 2A to be received between the fastener tape 30A and the restricting unit 50A, holding the side periphery 3A of the cover material 2A. Further, by folding the side periphery 3A of the cover material 2A to cover the front side of the restricting unit 50A, the first fastener stringer 20A is kept from being exposed at a front side of the cover material 2A.

(2) The second fastener stringer 20B includes the fastener tape 30B, the fastener element array 40B fixed to the fastener tape 30B, and the restricting unit 50B provided along the longitudinal direction of the fastener tape 30B, the restricting unit 50B being configured to form the space 21 receiving the side periphery 3B of the cover material 2B between the restricting unit 50B and the fastener tape 30B.

The second fastener stringer 20B is thus structurally the same as the first fastener stringer 20A, achieving the above effects in the same manner as the first fastener stringer 20A.

(3) Further, when the fastener element array 40A of the first fastener stringer 20A is engaged with the fastener element array 40B of the second fastener stringer 20B, the right and left cover materials 2A, 2B are bordered on each other to cover the fastener tapes 30A, 30B. If a force is applied to the right and left cover materials 2A, 2B in directions for the cover materials 2A, 2B to separate from each other, i.e., the right-left directions (Y-axis direction), the restricting units 50A, 50B would restrict the displacement of the cover materials 2A, 2B away from each other. The right and left cover materials 2A, 2B can thus be prevented from separating from each other, so that the fastener tapes 30A, 30B are less likely to be exposed outside.

(4) The restricting unit 50A is attached to the fastener tape 30A at a distance from the fastener element array 40A in the width direction of the fastener tape 30A and the restricting unit 50B is attached to the fastener tape 30B at a distance from the fastener element array 40B in the width direction of the fastener tape 30B.

The above configuration allows the fastener element array 40A, the fastener tape 30A, and the restricting unit 50A to form the continuous first fastener stringer 20A and the fastener element array 40B, the fastener tape 30B, and the restricting unit 50B to form the continuous second fastener stringer 20B. Thus, for instance, before being attached to the cover material 2, the first fastener stringer 20A and the second fastener stringer 20B are easy to handle as compared with a fastener stringer including a fastener tape and a restricting unit formed as separate components.

Further, the space 21 can be easily formed between the fastener tapes 30A, 30B and the restricting units 50A, 50B to receive the side peripheries 3A, 3B of the cover materials 2A, 2B, respectively, merely by folding each of the fastener tapes 30A, 30B at the side periphery 32 over the front side.

Second Exemplary Embodiment

A second exemplary embodiment of the invention will be described below with reference to the attached drawings.

Figure 6:
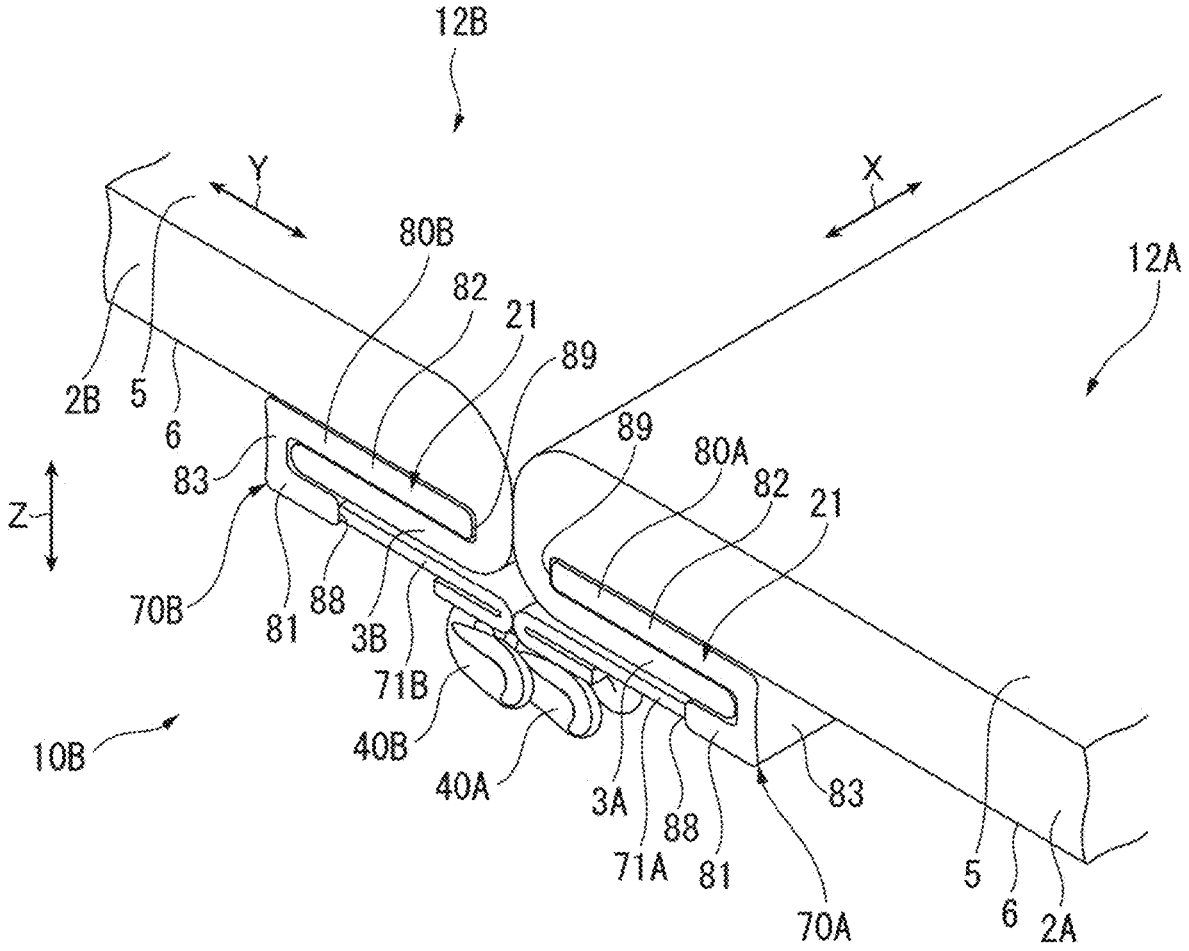
FIG. 6 is a perspective view showing a slide fastener according to a second exemplary embodiment of the invention.
Figure 7:
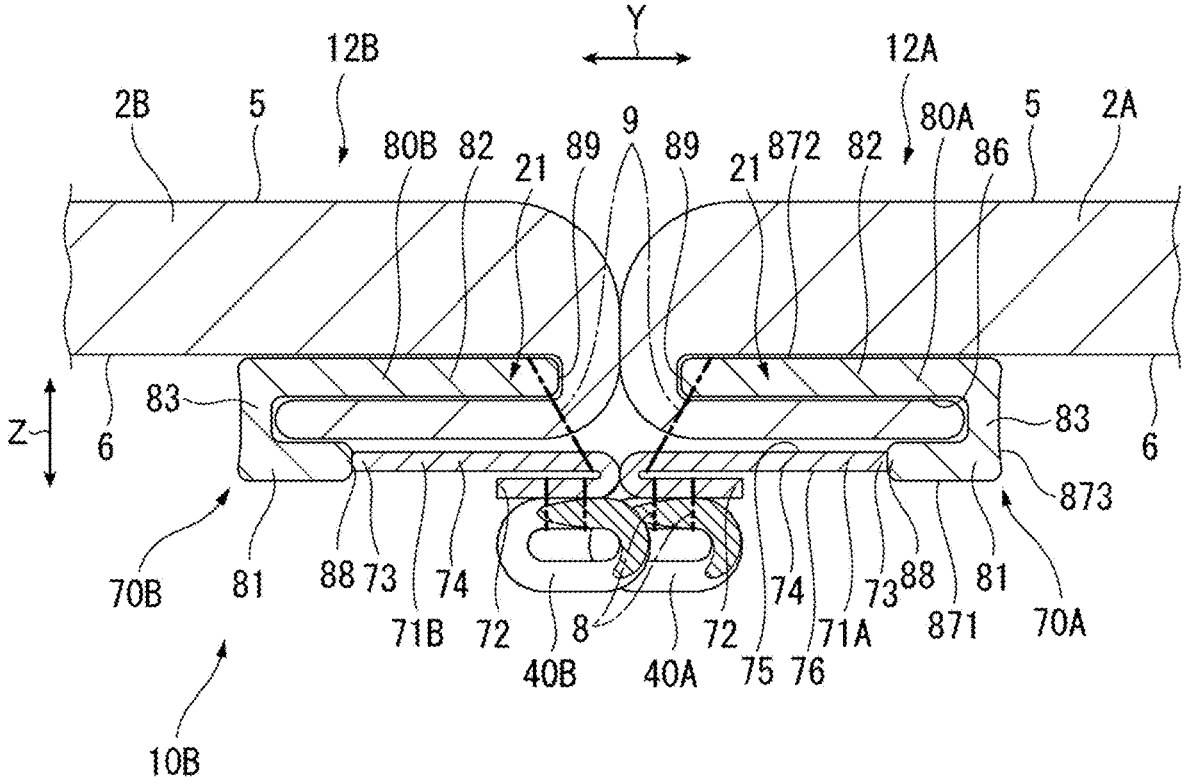
FIG. 7 is a cross sectional view showing the slide fastener according to the second exemplary embodiment.
Figure 8:
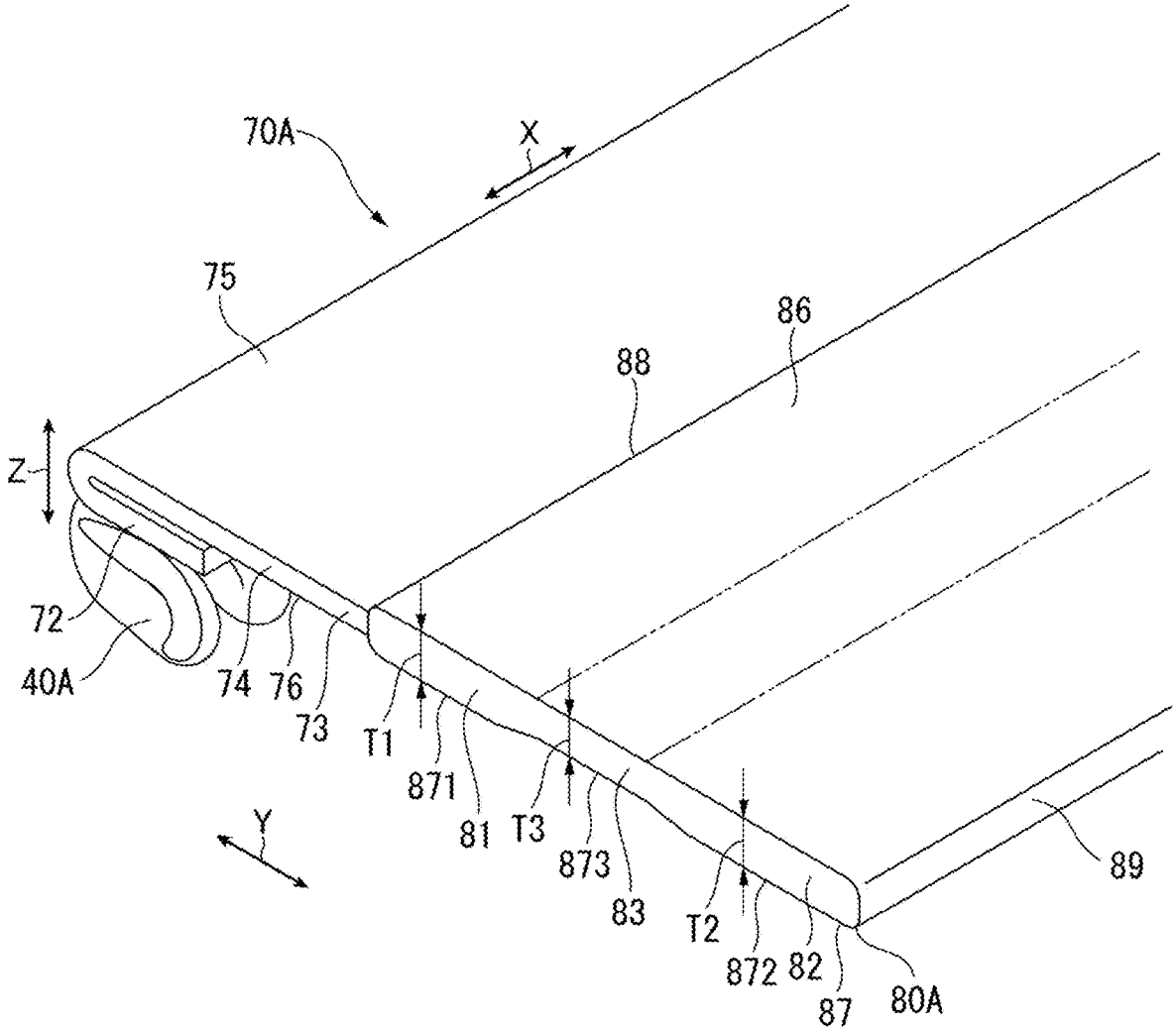
FIG. 8 is a perspective view showing a fastener stringer according to the second exemplary embodiment.

As shown in FIGS. 6 to 8, a slide fastener 10B of the second exemplary embodiment, which is configured to connect the cover materials 2A, 2B, includes a pair of first fastener stringer 70A and second fastener stringer 70B opposite in the Y-axis direction and the above-described slider 60 (see FIG. 1).

As shown in FIGS. 6 and 7, when the first fastener stringer 70A and the second fastener stringer 70B are engaged with each other, the right and left cover materials 2A, 2B are in contact with each other.

The first fastener stringer 70A includes a fastener tape 71A, the above-described fastener element array 40A fixed to the fastener tape 71A, and a restricting unit 80A provided along a longitudinal direction (X-axis direction) of the fastener tape 71A.

The fastener tape 71A, which is structurally substantially the same as the fastener tape 30A, has a width smaller than the width of the fastener tape 30A.

As shown in FIG. 7, the fastener element array 40A is sewed to a side periphery 72 of the fastener tape 71A in a width direction with the sewing thread 8, while the restricting unit 80A is attached to an opposite side periphery 73 of the fastener tape 71A in the width direction. It should be noted that a tape body 74 is defined between the side peripheries 72, 73 of the fastener tape 71A and the side periphery 72 of the fastener tape 71A is folded to face a rear surface 76 of the tape body 74.

The restricting unit 80A, which is formed into a belt shape from a hard synthetic resin such as polyamide, polyacetal, polypropylene, and polybutylene terephthalate, exhibits flexibility such that the restricting unit 80A is bendable in conformity with the bend of the cover material 2A. The restricting unit 80A includes an attachment piece 81 attached to the fastener tape 71A, a main piece 82 facing the fastener tape 71A to define the space 21 receiving the side periphery 3A of the cover material 2A, and a bendable piece 83 continuous with the attachment piece 81 and the main piece 82.

A surface 86 of the restricting unit 80A, which is shown at an upper side in FIG. 8, is flush across the attachment piece 81, the main piece 82, and the bendable piece 83. A surface 87 of the restricting unit 80A, which is shown at a lower side in FIGS. 8 and 9A, has a planar portion 873 corresponding to the bendable piece 83, a planar portion 871 corresponding to the attachment piece 81, and a planar portion 872 corresponding to the main piece 82, the planar portion 873 receding upward with respect to the planar portions 871, 872. Thus, a thickness T3 of the bendable piece 83 is smaller than respective thicknesses T1, T2 of the attachment piece 81 and the main piece 82, so that the bendable piece 83 is easier to bend to the front side than the attachment piece 81 and the main piece 82.

In the restricting unit 80A, merely the planar portion 873 of the surface 87 corresponding to the bendable piece 83 recedes. However, as shown in, for instance, FIG. 9B, a planar portion 863, which corresponds to the bendable piece 83, of the surface 86 of the restricting unit 80A may recede downward with respect to a planar portion 861 corresponding to the attachment piece 81 and a planar portion 862 corresponding to the main piece 82 and a width W5 of the planar portion 873 in the Y-axis direction may be larger than a width W6 of the planar portion 863 in the Y-axis direction. In this case, since the planar portion 873 recedes as described above, a tensile stress applied to the planar portion 873 of the bendable piece 83 as the bendable piece 83 of the restricting unit 80A is folded with the surface 86 facing itself as shown in FIG. 10 is reduced as compared with an instance where the planar portion 873 would not recede. Meanwhile, since the planar portion 863 recedes as described above, a compression stress applied to the planar portion 863 of the bendable piece 83 is reduced as compared with an instance where the planar portion 863 would not recede. Consequently, the bendable piece 83 can thus be bent with a smaller force.

Figure 9A:
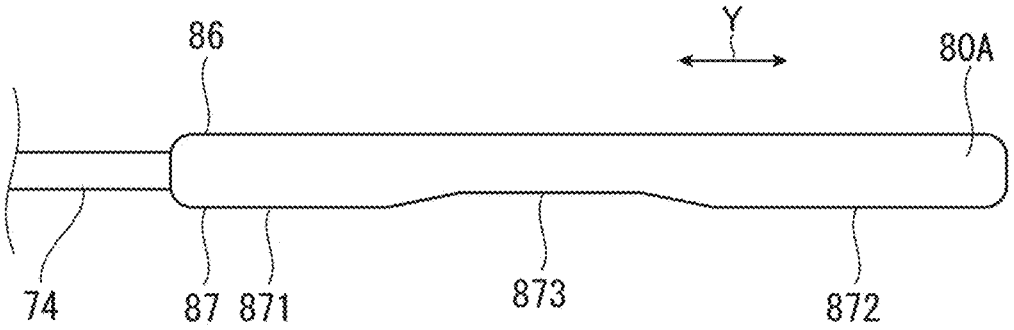
FIG. 9A is an end view showing a restricting unit according to the second exemplary embodiment.
Figure 9B:
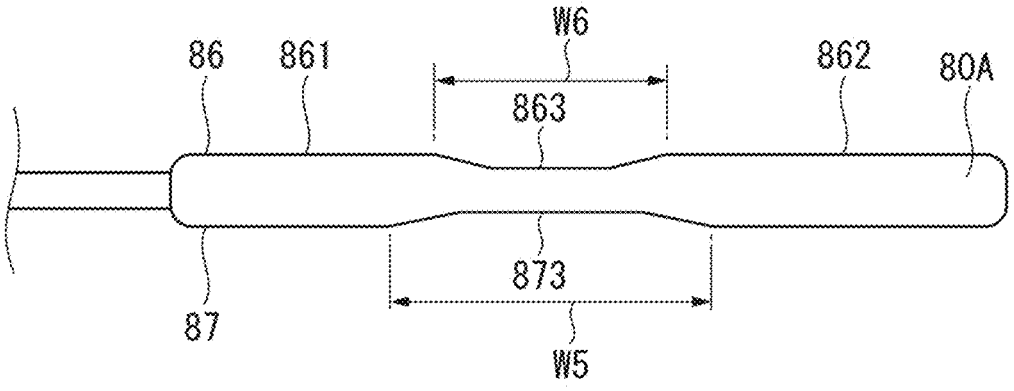
FIG. 9B is an end view showing the restricting unit according to the second exemplary embodiment.
Figure 9C:
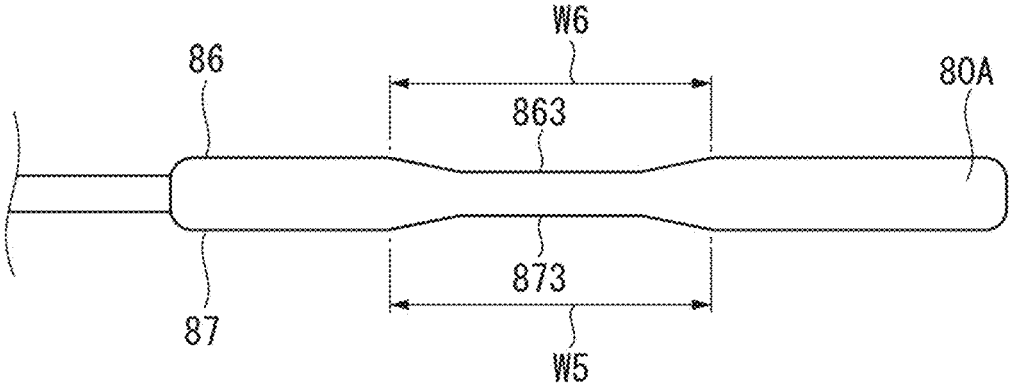
FIG. 9C is an end view showing the restricting unit according to the second exemplary embodiment.
Figure 10:
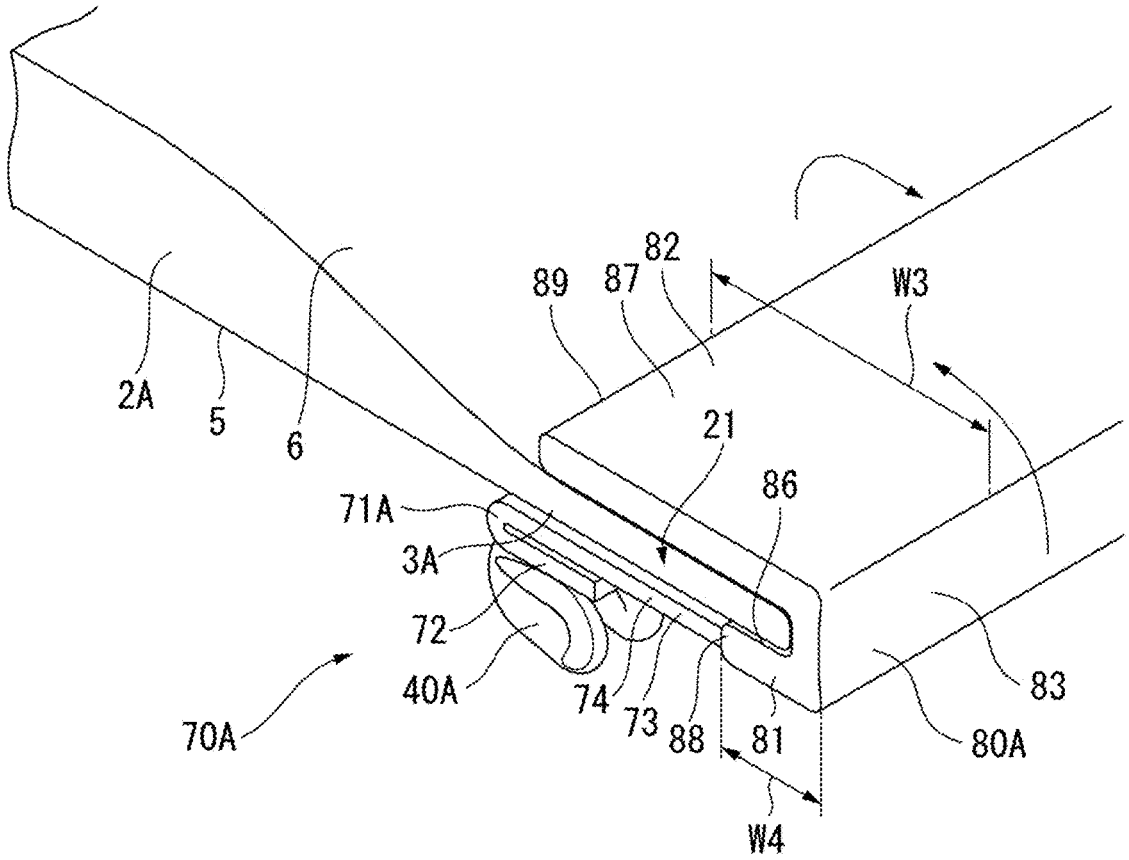
FIG. 10 is a perspective view showing a process of attaching the fastener stringer according to the second exemplary embodiment.

Referring to FIG. 9B, the width W5 of the planar portion 873 is larger than the width W6 of the planar portion 863 but, for instance, the widths W5, W6 may be equal as shown in FIG. 9C. In this case, the restricting unit 80A is similarly bendable with respect to either the front side or the rear side.

It should be noted that the restricting unit 80A with the arrangement shown in either FIG. 9A or FIG. 9B is easily bendable with respect to both the front side and the rear side as compared with an instance where the planar portion 873 and/or planar portion 863 would not recede.

It should also be noted that the respective thicknesses T1, T2 of the attachment piece 81 and the main piece 82 are the same in the exemplary embodiment. Additionally, as shown in FIG. 10, a width W3 of the main piece 82 is larger than a width W4 of the attachment piece 81.

A side periphery 88 of the restricting unit 80A in the width direction (i.e., a side periphery of the attachment piece 81) is attached to the side periphery 73 of the fastener tape 71A. An opposite side periphery 89 of the restricting unit 80A (i.e., a side periphery of the main piece 82) in the width direction is free.

The first fastener stringer 70A is attached to the cover material 2A as follows.

First, the first fastener stringer 70A in the state shown in FIG. 8 (the first fastener stringer 70A with the restricting unit 80A being unfolded along the Y-axis direction) is prepared and then a front surface 75 of the fastener tape 71A at the tape body 74 and the side periphery 73 is placed over the front surface 5 of the cover material 2A at the side periphery 3A.

Subsequently, as shown in FIG. 10, the bendable piece 83 of the restricting unit 80A is folded with the surface 86 facing itself, forming the space 21 between the restricting unit 80A and the tape body 74. At this time, the side periphery 89 of the restricting unit 80A (the side periphery of the main piece 82) is located inside in the right-left direction with respect to the bendable piece 83. The side periphery 3A of the cover material 2A is received in the space 21. The side periphery 3A of the cover material 2A is compressively deformed between the fastener tape 71A (and attachment piece 81) and the main piece 82 and sewed, as it is deformed, to the main piece 82 and the fastener tape 71A with the sewing thread 9 (see FIG. 7).

At the end, the cover material 2A is folded with respect to the side periphery 3A to cover the restricting unit 80A at a front side thereof (an upper side in the Z-axis direction in FIG. 7). When the first fastener stringer 70A is attached to the cover material 2A as described above, a fastener stringer attachment structure 12A is defined by the first fastener stringer 70A and the cover material 2A (see FIGS. 6 and 7).

The second fastener stringer 70B includes a fastener tape 71B, the above-described fastener element array 40B fixed to the fastener tape 71B, and a restricting unit 80B provided along a longitudinal direction (X-axis direction) of the fastener tape 71B. The fastener tape 71B and the restricting unit 80B are structurally the same as the fastener tape 71A and the restricting unit 80A of the first fastener stringer 70A. The second fastener stringer 70B is symmetric to the first fastener stringer 70A right and left.

The second fastener stringer 70B is attached to the cover material 2B in the same manner as the above-described first fastener stringer 70A being attached to the cover material 2A. A fastener stringer attachment structure 12B is thus defined by the second fastener stringer 70B and the cover material 2B.

Effects of Second Exemplary Embodiment

The slide fastener 10B of the second exemplary embodiment can achieve the same effects as those of the slide fastener 10 of the first exemplary embodiment. Additionally, the slide fastener 10B of the second exemplary embodiment can achieve the following effects.

(1) The restricting unit 80A includes the attachment piece 81 attached to the fastener tape 71A, the main piece 82 facing the fastener tape 71A to define the space 21 receiving the side periphery 3A of the cover material 2A, and the bendable piece 83 continuous with the attachment piece 81 and the main piece 82.

The main piece 82 can thus be folded with respect to the attachment piece 81 by bending the bendable piece 83 of the restricting unit 80A without the necessity of folding the fastener tape 71A, easily forming the space 21 receiving the side periphery 3A of the cover material 2A between the main piece 82 and the fastener tape 71A. The restricting unit 80B, which includes the attachment piece 81, the main piece 82, and the bendable piece 83 in the same manner as the restricting unit 80A, can achieve the above effects.

Further, the bendable piece 83 of the restricting unit 80A is clearly defined as a bending position, thus eliminating variation in bending position between the first fastener stringer 70A and the second fastener stringer 70B as compared with an instance where the fastener tape 71A would be bent.

(2) The attachment piece 81 is provided along the tape body 74 of each of the fastener tapes 71A, 71B, so that the width of the fastener tape 71A can be reduced depending on the width W4 of the attachment piece 81.

(3) Further, a dimension of the space 21 in the Z-axis direction can be determined by changing the width of the bendable piece 83.

Third Exemplary Embodiment

A third exemplary embodiment of the invention will be described below with reference to the attached drawings.

Figure 11:
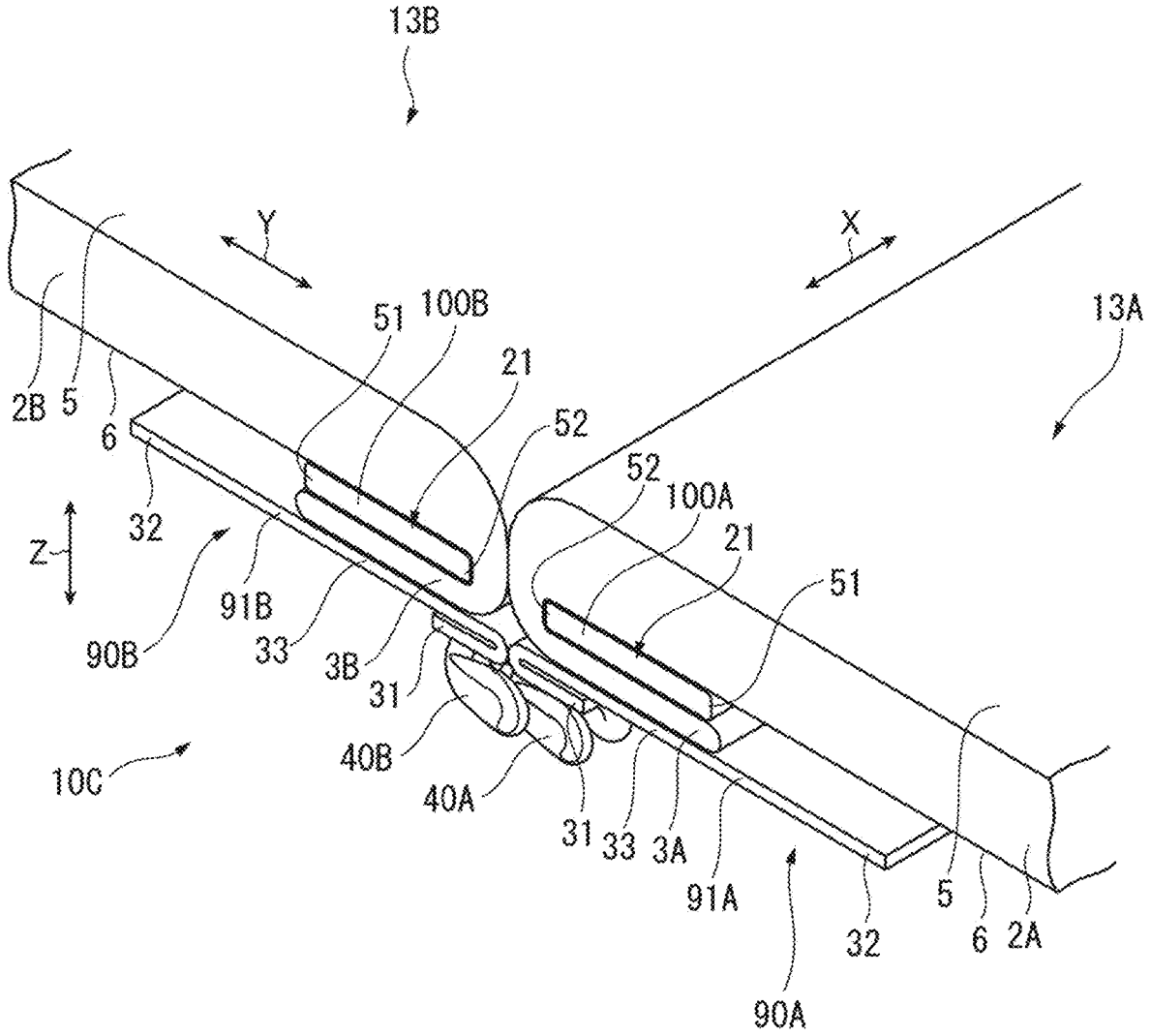
FIG. 11 is a perspective view showing a slide fastener according to a third exemplary embodiment of the invention.
Figure 12:
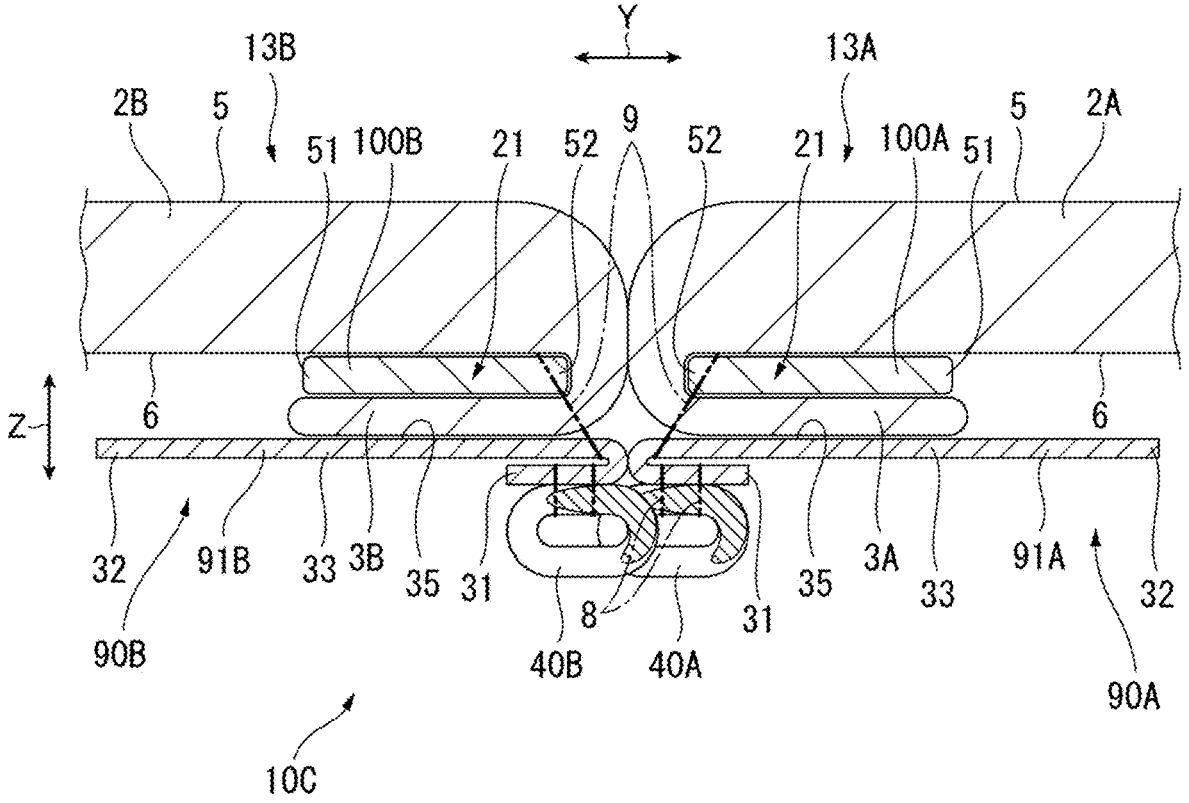
FIG. 12 is a cross sectional view showing the slide fastener according to the third exemplary embodiment.
Figure 13:
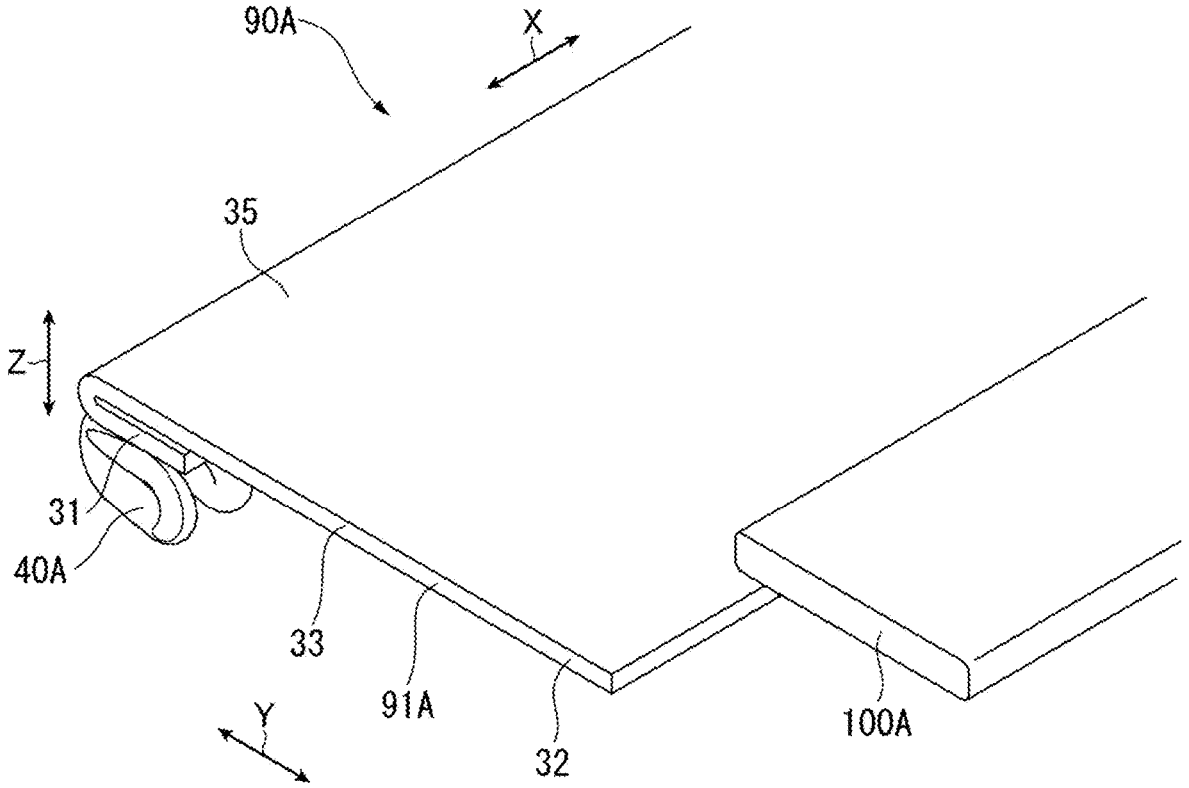
FIG. 13 is a perspective view showing a fastener stringer according to the third exemplary embodiment.

As shown in FIGS. 11 to 13, a slide fastener 10C of the third exemplary embodiment, which is configured to connect the cover materials 2A, 2B, includes a pair of first fastener stringer 90A and second fastener stringer 90B opposite in the Y-axis direction and the above-described slider 60 (see FIG. 1).

As shown in FIGS. 11 and 12, when the first fastener stringer 90A and the second fastener stringer 90B are engaged with each other, the right and left cover materials 2A, 2B are in contact with each other.

The first fastener stringer 90A includes a fastener tape 91A, the above-described fastener element array 40A fixed to the fastener tape 91A, and a restricting unit 100A provided along a longitudinal direction (X-axis direction) of the fastener tape 91A.

The fastener tape 91A is structurally the same as the fastener tape 30A except that the restricting unit 100A is not attached to the side periphery 32 of the fastener tape 91A.

The restricting unit 100A is structurally the same as the restricting unit 50A except that the side periphery 51 of the restricting unit 100A is not attached to the side periphery 32 of the fastener tape 91A.

Thus, when the first fastener stringer 90A is not attached to the cover material 2A as shown in FIG. 13, the restricting unit 100A is present as an independent member separate from the fastener tape 91A.

The first fastener stringer 90A is attached to the cover material 2A as follows.

First, the first fastener stringer 90A in the state shown in FIG. 13 is prepared and then the front surface 35 of the fastener tape 91A at the tape body 33 is placed facing the front surface 5 of the cover material 2A at the side periphery 3A.

Figure 14:
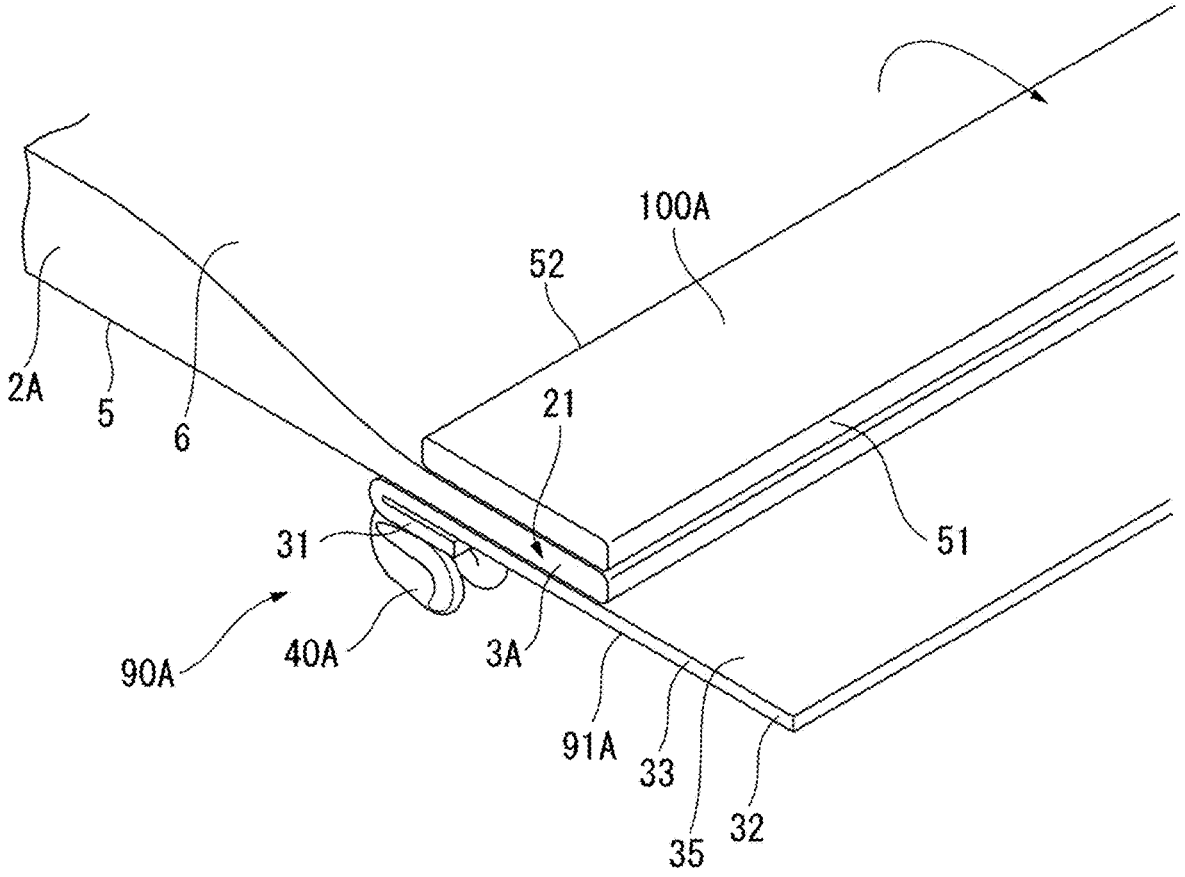
FIG. 14 is a perspective view showing a process of attaching the fastener stringer according to the third exemplary embodiment.

Subsequently, as shown in FIG. 14, the restricting unit 100A is placed facing a rear surface 6 of the cover material 2A at the side periphery 3A such that the space 21, in which the side periphery 3A is received, is formed between the restricting unit 100A and the tape body 33. The side periphery 3A of the cover material 2A is compressively deformed between the tape body 33 and the restricting unit 100A and sewed, as it is deformed, to the tape body 33 and the restricting unit 100A with the sewing thread 9 (see FIG. 12).

At the end, the cover material 2A is folded with respect to the side periphery 3A to cover the restricting unit 100A at a front side thereof (an upper side in the Z-axis direction in FIG. 12). When the first fastener stringer 90A is attached to the cover material 2A as described above, a fastener stringer attachment structure 13A is defined by the first fastener stringer 90A and the cover material 2A (see FIGS. 11 and 12).

The second fastener stringer 90B includes a fastener tape 91B, the above-described fastener element array 40B fixed to the fastener tape 91B, and a restricting unit 100B provided along a longitudinal direction (X-axis direction) of the fastener tape 91B as shown in FIGS. 11, 12. The fastener tape 91B and the restricting unit 100B are structurally the same as the fastener tape 91A and the restricting unit 100A of the first fastener stringer 90A, respectively. The second fastener stringer 90B is symmetric to the first fastener stringer 90A right and left.

The second fastener stringer 90B is attached to the cover material 2B in the same manner as the above-described first fastener stringer 90A being attached to the cover material 2A. A fastener stringer attachment structure 13B is thus defined by the second fastener stringer 90B and the cover material 2B (see FIGS. 11, 12).

Effects of Third Exemplary Embodiment

The slide fastener 10C of the third exemplary embodiment achieves substantially the same effects as those of the slide fastener 10 of the first exemplary embodiment. However, whereas each of the first fastener stringer 20A and the second fastener stringer 20B of the first exemplary embodiment is easy to handle as being a single component, the first fastener stringer 90A and the second fastener stringer 90B are not easy to handle when not attached to the cover materials 2A, 2B, since the restricting units 100A, 100B are present as independent members not attached to the fastener tapes 91A, 91B.

On the other hand, the positions of the restricting units 100A, 100B, which are independent members, can be determined as desired irrespective of the width of the fastener tapes 91A, 91B or the like, forming the space 21 to receive the side peripheries 3A, 3B of the cover materials 2A, 2B.

Further, the restricting units 100A, 100B are connected to the fastener tapes 91A, 91B by, for instance, sewing at positions where the space 21 for receiving the side peripheries 3A, 3B of the cover materials 2A, 2B is formed between the restricting units 100A, 100B and the respective fastener tapes 91A, 91B, thereby restricting the displacement of the restricting units 100A, 100B. The restricting units 100A, 100B thus allow for restricting the cover materials 2A, 2B from being displaced right and left from each other.

Modification(s)

The invention is not limited to the above-described exemplary embodiments but may include any modifications not hampering the achievement of the object of the invention.

In the first to third exemplary embodiments, the belt-shaped restricting units 50A, 50B, 80A, 80B, 100A, 100B provided along the X-axis direction are not provided with, for instance, a groove. However, instead of these restricting units, for instance, restricting units 110A, 110B provided with at least one restricting groove 111 may be used as in a first modification shown in FIG. 15. It should be noted that FIG. 15 shows the same fastener tapes 30A, 30B as in the first exemplary embodiment for the convenience of explanation but the restricting units 110A, 110B are not necessarily attached to the side peripheries 32.

Figure 15:
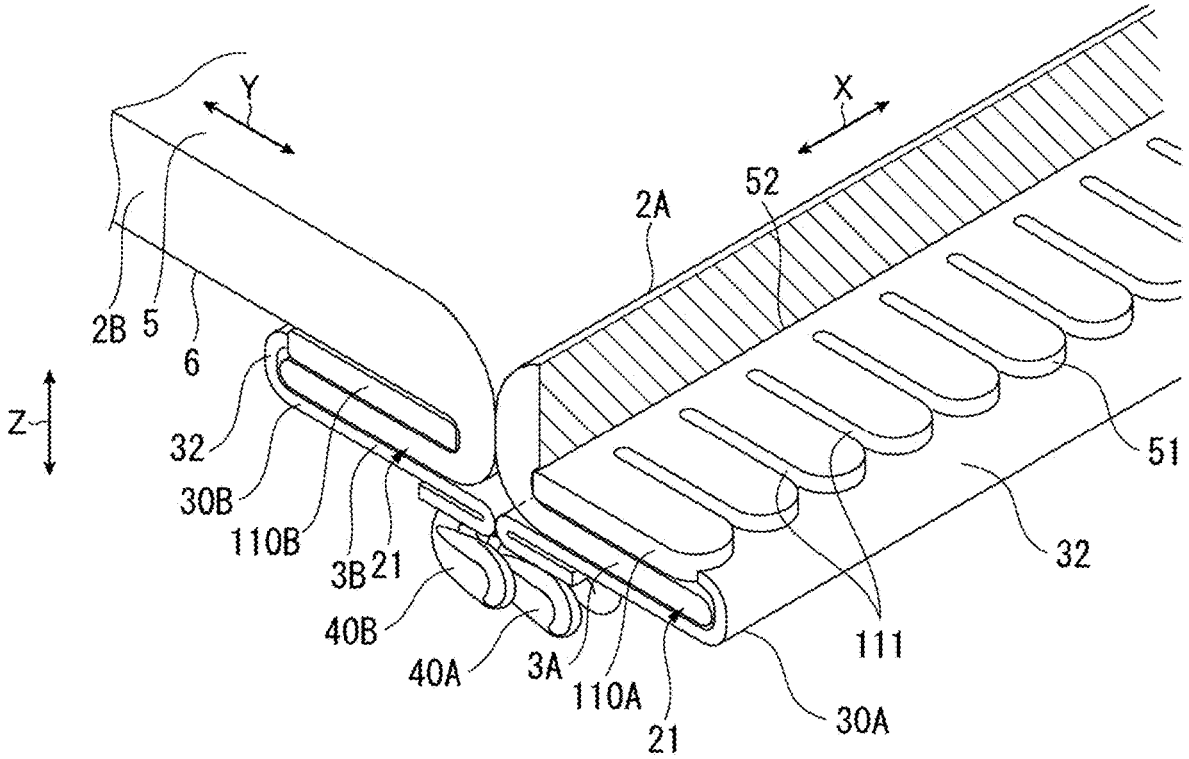
FIG. 15 is a perspective view showing a restricting unit according to a first modification of the invention.

The restricting unit 110A shown in FIG. 15 is in the form of a belt shape along the X-axis direction with the side periphery 52, which is located inside in the right-left direction in FIG. 15, being continuous along the X-axis direction.

For instance, the plurality of restricting grooves 111 extend in the Y-axis direction from the side periphery 51, which is located outside in the right-left direction in FIG. 15, toward the side periphery 52 of the restricting unit 110A, while being juxtaposed in the X-axis direction.

The above configuration, in which the restricting grooves 111 provided to the side periphery 51 of the restricting unit 110A are juxtaposed along the X-axis direction, allows for formation of narrow portions in the side periphery 52 of the restricting unit 110A along the X-axis direction, making the belt-shaped restricting unit 110A easy to bend right and left. The restricting unit 110A can thus be easily curved in conformity with the curve of the side periphery 3A of the cover material 2A so that, for instance, the right and left cover materials 2A, 2B are curved to be connected.

Further, the restricting grooves 111 are located outside in the right-left direction with the space 21 receiving the cover material 2A being formed between the fastener tape 30A and the restricting unit 110A, while the continuous side periphery 52 of the restricting unit 110A is located inside in the right-left direction. Thus, if a force is applied to the right and left cover materials 2A, 2B to separate them in the right-left direction, the continuous side periphery 52 of the restricting unit 110A can receive the cover material 2A, preventing the cover material 2A from being stuck in the restricting grooves 111 to unintentionally form wrinkles or the like on the cover material 2A. Thus, the right and left cover materials 2A, 2B can be smoothened in appearance without the wrinkles or the like at a curved connection portion therebetween.

It should be noted that the restricting unit 110B, which is structurally the same as the restricting unit 110A but symmetric thereto right and left, can achieve the above effects.

Referring to FIG. 15, the plurality of restricting grooves 111 are provided merely to the side periphery 51 of the restricting unit 110A located outside in the right-left direction but the invention is not limited thereto. For instance, the plurality of restricting grooves 111 are provided merely to the side periphery 52 of the restricting unit 110A located inside in the right-left direction in some exemplary embodiments. Further, the plurality of restricting grooves 111 are provided to each of the side peripheries 51, 52 in some exemplary embodiments. In this case, the plurality of restricting grooves 111 of the side periphery 51 and the plurality of restricting grooves 111 of the side periphery 52 may be alternately arranged along the X-axis direction.

Figure 16:
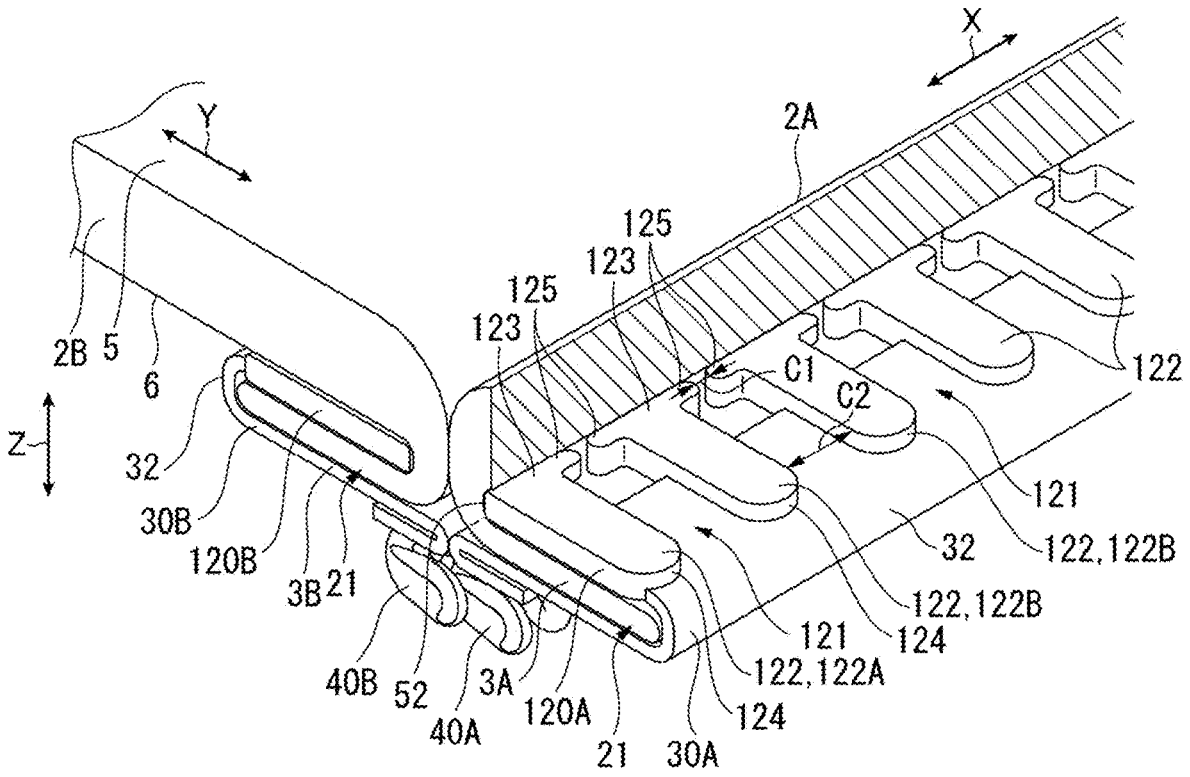
FIG. 16 is a perspective view showing a restricting unit according to a second modification of the invention.

Further, instead of the above-described restricting units 50A, 50B, 80A, 80B, 100A, 100B of the first to third exemplary embodiments, restricting units 120A, 120B may be provided as in a second modification shown in FIG. 16, the restricting units 120A, 120B each having the side periphery 52 discontinuous along the X-axis direction contrary to the restricting units 110A, 110B.

The restricting unit 120A shown in FIG. 16 includes a plurality of restricting members 122 juxtaposed at a distance 121 along the X-axis direction. In the state shown in FIG. 16, the restricting members 122 each have a side periphery 123 located inside in the right-left direction and a side periphery 124 located outside in the right-left direction.

The plurality of restricting members 122 each include restricting members 122A (end restricting members) located at opposite ends in the X-axis direction and a plurality of restricting members 122B (middle restricting members) located between the opposite ends.

An extension 125 is provided to the side periphery 123 of each restricting member 122A, extending in the X-axis direction toward the adjacent one of the restricting members 122B. The extension 125 is provided to the side periphery 123 of each restricting member 122B, extending at each side thereof in the X-axis direction. With the presence of the extensions 125 of the side peripheries 123, a distance C1 between the side peripheries 123 of the restricting members 122 is smaller than a distance C2 between the side peripheries 124 located outside in the right-left direction with respect to the side peripheries 123.

This configuration, in which the plurality of restricting members 122 of the restricting unit 120A are juxtaposed at the distance 121, allows the first fastener stringers 20A, 70A, 90A to be easily bendable right and left as compared with, for instance, the belt-shaped restricting unit 110A. The first fastener stringers 20A, 70A, 90A can thus be easily curved in conformity with the curve of the side periphery 3A of the cover material 2A so that, for instance, the right and left cover materials 2A, 2B are curved to be connected.

Further, since the distance C1 between the side peripheries 123 of the plurality of restricting members 122 of the restricting unit 120A located inside in the right-left direction is smaller than the distance C2 between the portions located outside in the right-left direction, the cover material 2A is less likely to be stuck between the side peripheries 123 of the plurality of restricting members 122 located inside in the right-left direction when a force is applied to the right and left cover materials 2A, 2B to separate them in the right-left direction. Thus, unintentional wrinkles or the like of the cover material 2A can be reduced. This results in a smooth appearance of the right and left cover materials 2A, 2B with wrinkles or the like being reduced at a curved connection portion as described above.

Further, the restricting unit 120A, which includes the plurality of restricting members 122, can eliminate the necessity of forming a continuous portion in the X-axis direction, thus reducing material costs.

It should be noted that the restricting unit 120B, which is structurally the same as the restricting unit 120A but symmetric thereto right and left, can achieve the above effects.

In the first to third exemplary embodiments, the fastener tapes 30A, 30B, 91A, 91B are partly present at a rear position (a lower position in the Z-axis direction in FIG. 17) outside in the right-left direction with respect to the restricting units 50A, 50B, 80A, 80B, 100A, 100B or are not provided. A support 130 may be provided at this position as in a third modification shown in, for instance, FIG. 17.

Figure 17:
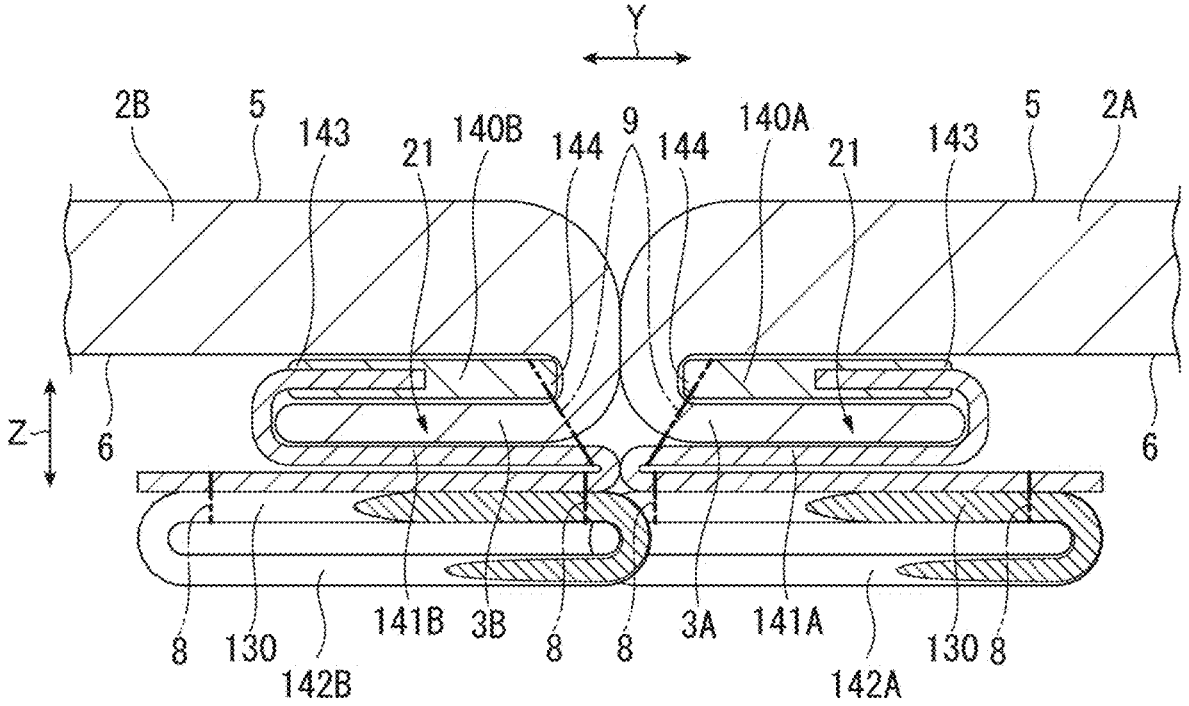
FIG. 17 is a cross sectional view showing a support according to a third modification of the invention.

FIG. 17 shows fastener tapes 141A, 141B, fastener element arrays 142A, 142B fixed to the fastener tapes 141A, 141B, respectively, and restricting units 140A, 140B provided along respective longitudinal directions of the fastener tapes 141A, 141B.

The fastener element arrays 142A, 142B, which are wider than the restricting units 140A, 140B, each define a support 130 located behind (below in the Z-axis direction shown in FIG. 17) a side periphery 143 (i.e., an outer periphery in the right-left direction) of the corresponding one of the restricting units 140A, 140B.

In the above configuration, the support 130 is provided at a position for the support 130 and the restricting unit 140A (140B) to receive therebetween the side periphery 3A (3B) of the cover material 2A (2B) and the fastener tape 141A (141B). If a force is applied to the right and left cover materials 2A, 2B to separate them in the right-left direction, each of the restricting units 140A, 140B would tend to incline such that the side periphery 144, which is located inside the right-left direction, rising toward a front side (an upper side in the Z-axis direction in FIG. 17) and the side periphery 143, which is located outside in the right-left direction, receding toward a rear side. However, since the support 130 supports the side periphery 143 of the restricting unit 140A (140B) located outside in the right-left direction, such inclination can be reduced, keeping the right and left cover materials 2A, 2B in contact with each other.

It should be noted that FIG. 17 shows that the restricting units 140A, 140B are attached to the respective side peripheries of the fastener tapes 141A, 141B but are attached in a different manner in some exemplary embodiments. Further, the restricting units 140A, 140B are in the form of any ones of the above-described restricting units 50A, 50B, 80A, 80B, 100A, 100B, 110A, 110B, and 120A, 120B in some exemplary embodiments.

FIG. 17 shows that the fastener element arrays 142A, 142B each define the support 130 but the invention is not limited thereto. For instance, the support 130 is a supporting member located outside in the right-left direction with respect to each of the fastener element arrays 40A, 40B in some exemplary embodiments.

In the first and second exemplary embodiments, the restricting units 50A, 50B are attached to the side peripheries 32 of the fastener tapes 30A, 30B, respectively, while the restricting units 80A, 80B are attached to the side peripheries 73 of the fastener tapes 71A, 71B, respectively. However, restricting units 50A, 50B or the restricting units 80A, 80B are attached at portions different from the side peripheries 32 or the side peripheries 73 in some exemplary embodiments.

In the first and second exemplary embodiments, the restricting units 50A, 50B, 80A, 80B are made of a hard synthetic resin but the invention is not limited thereto. For instance, the restricting units are formed by curing the side peripheries 32 of the fastener tapes 30A, 30B or the side peripheries 73 of the fastener tapes 71A, 71B in some exemplary embodiments.

In the first to third exemplary embodiments, the fastener element arrays 40A, 40B are each a linear element formed from a synthetic resin monofilament into a coil shape but the invention is not limited thereto. For instance, various types of fastener element arrays are can be employed, including a fastener element array including block members with meshing heads juxtaposed along the X-axis direction, a fastener element array including an injection-molded resin element, and a fastener element array including a metal element.

In the above-described exemplary embodiments, the slide fasteners 10, 10B, 10C are described as a device for connecting the right and left cover materials 2A, 2B of the sheet cover for the car seat 1 but are used as a device for connecting right and left cover materials for, for instance, bags, clothing, and furniture (e.g., chair and sofa) in some exemplary embodiments.

What is claimed is:

1. A fastener stringer attachment structure comprising: a pair of right and left fastener stringers: and right and left cover materials configured to be attached with the pair of right and left fastener stringers, respectively, wherein the pair of right and left fastener stringers each comprise: a fastener tape; a fastener element array fixed to the fastener tape; and a restricting unit provided along a longitudinal direction of the fastener tape, the restricting unit of at least one of the pair of right and left fastener stringers is being configured to form a space that receives a side periphery of the cover material between the restricting unit and the fastener tape of the at least one of the pair of right and left fastener stringers, and the restricting unit of the at least one of the pair of right and left fastener stringers and the restricting unit of the other one of the pair of right and left fastener stringers are configured to form a second space that receives the right and left cover materials between the restricting units.

2. The fastener stringer attachment structure according to claim 1, wherein the restricting unit is attached to the fastener tape at a position spaced from the fastener element array in a width direction of the fastener tape.

3. The fastener stringer attachment structure according to claim 1, wherein the restricting unit comprises:

an attachment piece attached to the fastener tape;

a main piece configured to form the space receiving the side periphery of the cover material between the main piece and the fastener tape; and a bendable piece continuous with the attachment piece and the main piece.

4. The fastener stringer attachment structure according to claim 1, wherein the restricting unit is a member separate from the fastener tape and connectable to the fastener tape at a position for the restricting unit to form the space receiving the side periphery of the cover material between the restricting unit and the fastener tape.

5. The fastener stringer attachment structure according to claim 1, wherein the restricting unit is in a belt shape along the longitudinal direction of the fastener tape, and at least a first side periphery of the restricting unit is provided with at least one restricting groove juxtaposed along a longitudinal direction of the restricting unit.

6. The fastener stringer attachment structure according to claim 5, wherein the first side periphery of the restricting unit is provided with the at least one restricting groove, a second side periphery of the restricting unit is continuous along the longitudinal direction of the restricting unit, and the first side periphery of the restricting unit is located outside in a right-left direction when the space receiving the cover material is formed between the fastener tape and the restricting unit.

7. The fastener stringer attachment structure according to claim 1, wherein the restricting unit comprises a plurality of restricting members juxtaposed at a distance along the longitudinal direction of the fastener tape, and the plurality of restricting members have respective side peripheries that are located inside in a right-left direction when the space receiving the side periphery of the cover material is formed between the fastener tape and the restricting unit, a distance between the respective side peripheries being smaller than a distance between the other portions of the plurality of restricting members that are located outside in the right-left direction with respect to the respective side peripheries.

8. The fastener stringer attachment structure according to claim 1, further comprising a support positioned so that the side periphery of the cover material and the fastener tape are between the support and the restricting unit when the restricting unit is at a position for the restricting unit to form the space that receives the cover material between the restricting unit and the fastener tape.

9. A slide fastener comprising:

the pair of right and left fastener stringers of the fastener stringer attachment structure according to claim 1; and a slider configured to engage the pair of right and left fastener stringers.

* * * * *